US007310409B2

(12) United States Patent
Tanaka

(10) Patent No.: US 7,310,409 B2
(45) Date of Patent: Dec. 18, 2007

(54) ELECTROMAGNETIC WAVE GENERATOR

(75) Inventor: Hirofumi Tanaka, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/407,332

(22) Filed: Apr. 20, 2006

(65) Prior Publication Data

US 2006/0249685 A1 Nov. 9, 2006

(30) Foreign Application Priority Data

Apr. 26, 2005 (JP) ..... 2005-128120

(51) Int. Cl.
*H01J 35/30* (2006.01)

(52) U.S. Cl. ..... 378/137; 378/138

(58) Field of Classification Search ..... 378/137, 378/57, 118, 109, 119
See application file for complete search history.

(56) References Cited

U.S. PATENT DOCUMENTS 5,680,018 A 10/1997 Yamada
7,190,764 B2 * 3/2007 Mori et al. ..... 378/124

FOREIGN PATENT DOCUMENTS

JP 08-195300 7/1996
JP 2004-296164 10/2004
WO WO 2004/073364 8/2004

OTHER PUBLICATIONS

Tanaka et a., "Design and Construction of a Spiral Magnet for a Hybrid Accelerator", Proceedings of the 1st annual meeting of Particle Accelerator Society of Japan and the 29th Linear Accelerator Meeting in Japan, Aug. 4-6, 2004, Japan, pp. 465-467.
Tanaka et al., Hybrid Accelerator Using an FFAG Injection Scheme, Cyclotrons and Their Applications, 2004, 17th International Conference.
Kamei et al., "Chapter 4 Betatron", Acceleration Science(Parity Physics Course), Maruzen Inc., Sep. 20, 1993, ISBN 4-621-03873-7, pp. 39-43.

* cited by examiner

*Primary Examiner*—Hoon Song
(74) *Attorney, Agent, or Firm*—Leydig, Voit & Mayer, Ltd.

(57) ABSTRACT

A compact and low-cost electromagnetic wave generator in which X-rays having high intensity can be generated and the energy of generated X-rays can rapidly be switched. In an electromagnetic wave generator including a circular accelerator, a deflection electromagnet incorporated in the circular accelerator focuses injected and accelerated electrons. The circular accelerator produces stable closed electron orbits in respective regions with respective widths in the radial direction of the accelerator. The closed electron orbits are stable during injection and acceleration of electrons. A target is arranged across only some of the stable closed electron orbits so that a collision region, where a circulating electron beam collides with the target, and a non-collision region, where a circulating electron beam does not collide with the target, are produced. Through control of respective patterns of changes with time of the deflection magnetic field, a given electron closed orbit is shifted between the collision and the non-collision regions, thereby generating X-rays.

5 Claims, 6 Drawing Sheets

ELECTROMAGNETIC WAVE GENERATOR

BACKGROUND OF THE INVENTION

1. Field of the Invention

The present invention relates to an electromagnetic wave generator for generating electromagnetic waves such as X-rays, by means of electrons that, within an accelerator, circulate while forming a circular orbit.

2. Description of the Related Art

Conventional electromagnetic wave generators utilizing a circular accelerator include a generator (Non-Patent Literature 1) utilizing an accelerator (shortly referred to as a betatron accelerator) based on the betatron acceleration principle and a generator (Patent Literature 1) utilizing an electron storage ring.

In an electromagnetic wave generator utilizing a betatron accelerator, electrons injected into the generator are accelerated, while circulating in an orbit of a constant radius; when their energy have reached a predetermined level, the electrons are made to change its orbit, whereby the electrons collide with a target arranged in the resultant orbit, thereby generating X-rays (Non-Patent Literature 1).

In addition, an electromagnetic wave generator utilizing an electron storage ring is configured of an injector and the electron storage ring; electrons that have been accelerated so as to have predetermined energy are injected from the injector into the electron storage ring and circulate along constant orbits within the ring. In the closed orbit, a target is arranged; the collision between the target and the circulating electron beam generates X-rays (Patent Literature 1).

[Non-Patent Literature 1] Accelerator Science (Parity Physics Course) co-authored by Toru Kamei and Motohiro Kihara, published by Maruzen Co., Ltd., on Sep. 20$^{th}$, 1993 (ISBN 4-621-03873-7 C3342), Chapter 4 "Betatron", 39p-43p [Patent Literature 1] Japanese Patent No. 2796071

The foregoing electromagnetic wave generators have the problems described below. In an electromagnetic wave generator utilizing a betatron accelerator (Non-Patent Literature 1), due to coulomb repulsion between electrons that circulate within the accelerator, high-current acceleration is difficult to implement. Accordingly, compared with an electromagnetic wave generator utilizing a linear accelerator, the intensity of accelerated electrons are small by approximately one or two digits. In addition, in this type of accelerator, an electron dosed orbit is maintained constant while an electron beam is accelerated so as to have predetermined energy. Accordingly, in order to make the beam collide with a target, its orbit is required to be shifted to the orbit in which the target for generating X-rays is arranged. However, the beam off the closed orbit cannot stably circulate, whereby it is difficult for the beam to collide with the target repeatedly. For that reason, the intensity of generated X-rays is low; therefore, it has been almost impossible that an electromagnetic wave generator utilizing a betatron accelerator is applied to the industrial or the medical field.

In addition, in order to obtain X-rays having different energy levels, the energy of electrons that are made to collide with a target is required to be changed; however, in a betatron accelerator, an electron beam whose orbit has been changed to another orbit in which the electron beam collides with the target cannot stably circulate, whereby the electron beam disappears. Accordingly, in order to generate the next X-rays, injection and acceleration are required to be resumed; therefore, it has been impossible to generate X-rays having different energy levels, in a high-speed switching fashion. Furthermore, because the consistency in the respective positions of injected electron beams is not necessarily accurate, the position where the electron beam collides with the target may subtly be shifted from one another. Accordingly, the precise measurement, through the high-speed energy subtraction method, on a movable subject has been difficult due to problems in high-speed switching of X-ray energy and in consistency in the respective X-ray-source positions for electron beam injections. Moreover, when, even in the case where the high speed is not required, measurement is implemented through the energy subtraction method, a subtle positional shift of an electron beam that collides with the target causes a positional shift of an X-ray source, whereby it has been difficult to implement precise measurement.

In an electromagnetic wave generator utilizing an electron storage ring (Patent Literature 1), the closed orbit of an electron beam is basically constant; therefore, it is possible to make the electron beam recurrently collide with the target, whereby the X-ray intensity is improved, compared with a betatron accelerator. However, in an electromagnetic wave generator utilizing an electron storage ring, it is difficult to make the value of the injection current large, and an injector and an electron storage ring for accelerating electrons so as to have predetermined energy, whereby the generator becomes large-scale; therefore, the number of constituent apparatuses increases and control is rendered complicated. As a result, the electromagnetic wave generator has been high-cost and its application fields have been limited.

Even though having a function of maintaining the energy of circulating electrons at a predetermined value, the storage ring does not have a function of varying the energy; in order to vary the energy, it is necessary to vary in the injector the injection energy of the electrons to be injected into the storage ring. Accordingly, also in this case, as is the case with a betatron accelerator, it is difficult to generate X-rays having different energy levels, in a high-speed switching fashion; therefore, as is the case with a betatron accelerator, the application fields of the electromagnetic wave generator utilizing an electron storage ring is limited. In addition, if the storage ring is provided with an acceleration function and utilized as a synchrotron accelerator, it is possible to vary the energy of an electron beam that is already circulating within the accelerator; however, it is difficult to ensure the high-speed energy switching, and a further problem is that, in that accelerator, the closed orbit of an electron beam is constant even during the acceleration, whereby, during the acceleration, the target has to be arranged off the closed orbit so that the collision between the electron beam and the target should be avoided. In this case, after colliding with the target, the circulating electron beam cannot stably circulate; therefore, as is the case with a betatron accelerator, it is difficult for the electron beam to collide with the target repeatedly.

SUMMARY OF THE INVENTION

The present invention has been implemented in order to cope with the problems discussed above, and realizes a compact and low-cost electromagnetic wave generator in which, compared with a conventional electromagnetic wave generator, high intensity X-rays can be generated and the energy of generated X-rays can be switched at high speed.

An electromagnetic wave generator and an electromagnetic-wave generation method according to the present invention are characterized in that, in a circular accelerator including an electron generator for generating electrons, an injector for injecting electrons from the electron generator, an accelerator for accelerating the injected electrons, a deflection electromagnet for generating a deflection magnetic field to deflect the injected electrons or accelerated electrons, and a target with which the accelerated electrons are made to collide, whereby electromagnetic waves are generated, the shape of the deflection electromagnet enables a focusing function for injected electrons or accelerated electrons, the circular accelerator has electron closed orbits that, through the deflection electromagnet having the focusing function, are situated in a region with a predetermined width in the radial direction thereof and stable during the entire process including an injection step and an acceleration step, the target is arranged across the stable electron closed orbits and, in accordance with the arrangement position of the target, a collision region where a circulating electron beam collides with the target and at least one region that is adjacent to the collision region and in which a circulating electron beam does not collide with the target are formed, within the stable electron closed orbits, and through control of respective patterns of changes with time in a deflection magnetic field created by the deflection electromagnet and in electron-beam acceleration, a given electron closed orbit is shifted between the collision and the non-collision regions, whereby the target and a circulating electron beam collide with each other, thereby generating electromagnetic waves.

With the electromagnetic wave generator according to the present invention, electron beams that stably circulate along different orbits can be made to collide with the target recurrently; therefore, high-intensity X-rays can be generated, and X-rays that have different energy levels can be switchably generated at high speed. Accordingly, an X-ray image can be obtained in a short time. Moreover, a plurality of X-ray images through X-rays having different energy levels can rapidly be obtained, whereby provision is made for an X-ray generation source suitable for the high-speed energy subtraction method.

DETAILED DESCRIPTION OF THE PREFERRED EMBODIMENTS

Embodiment 1

Figure 1:
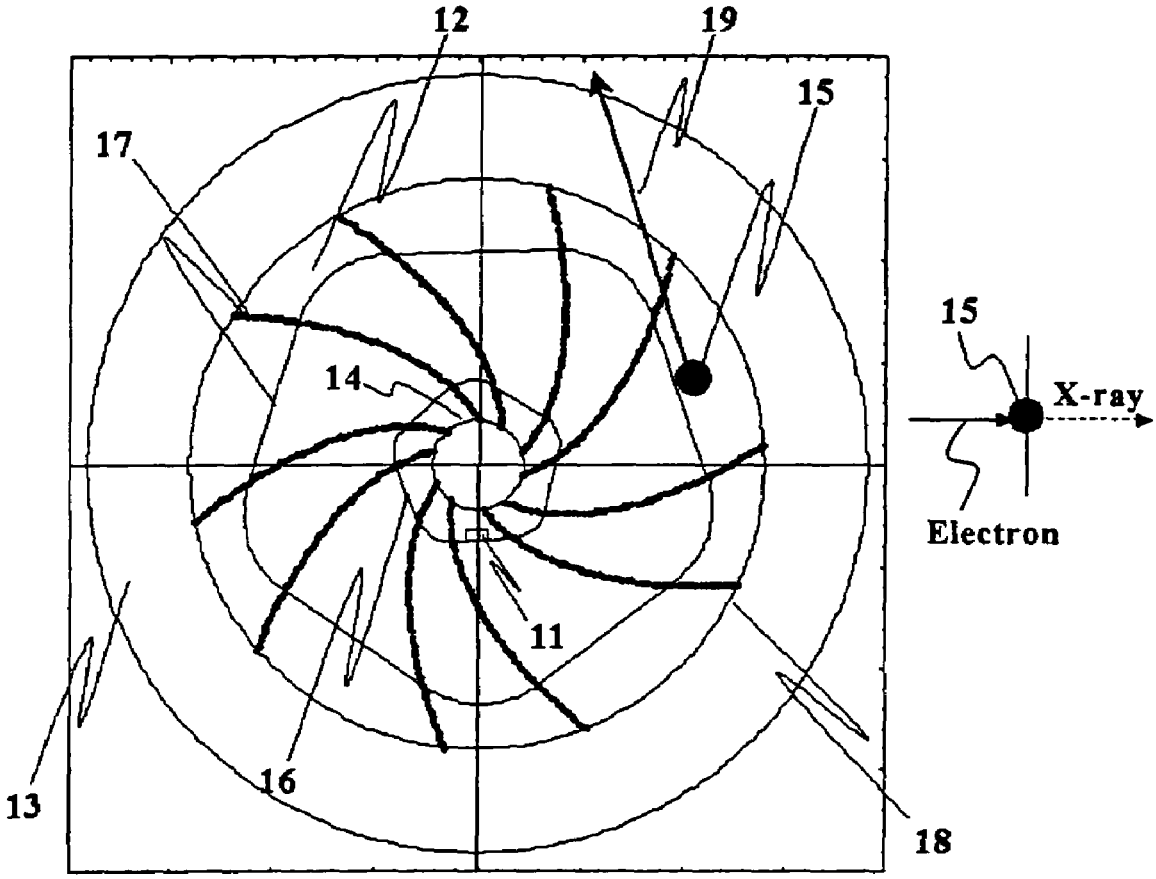
FIG. 1 is a view illustrating Configuration Example 1 of an electromagnetic wave generator according to the present invention.
Figure 2:
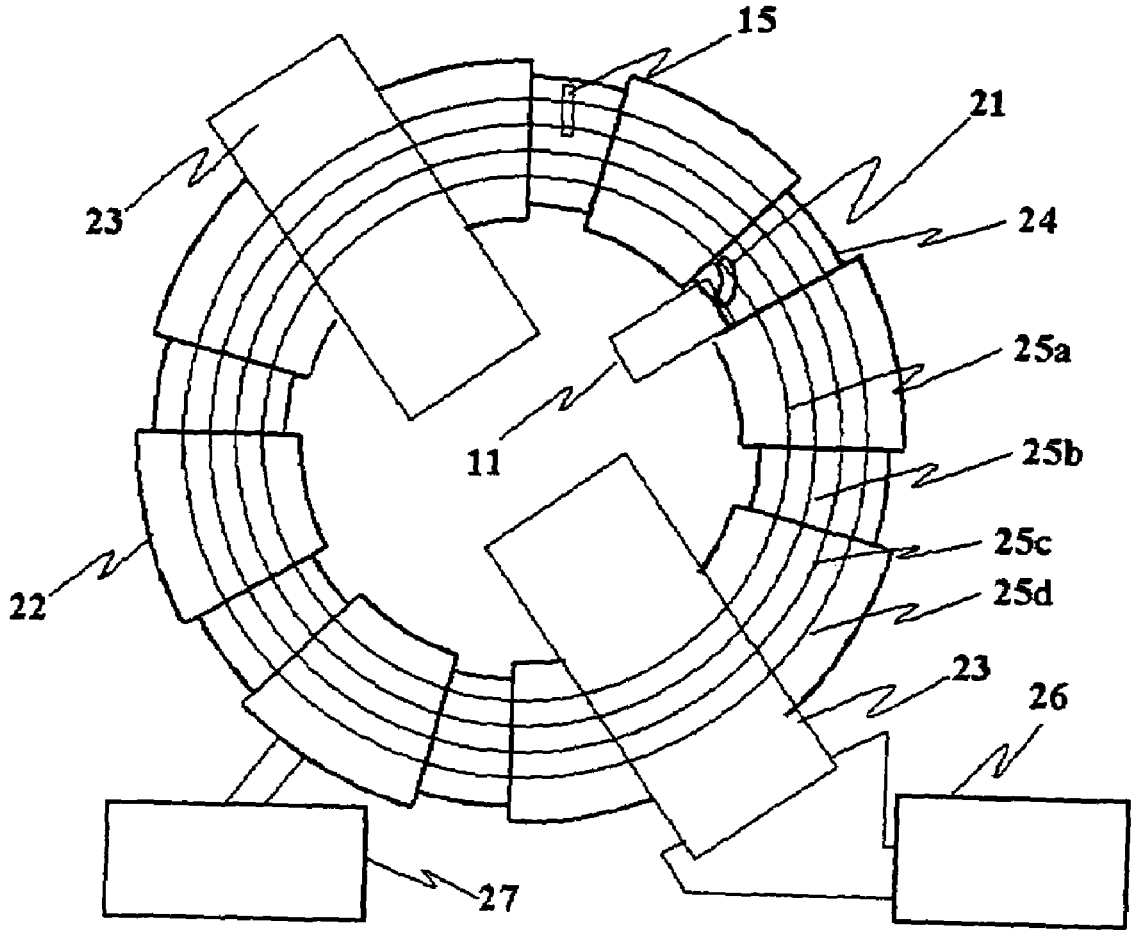
FIG. 2 is a view illustrating Configuration Example 2 of an electromagnetic wave generator according to the present invention.

FIGS. 1 and 2 are views illustrating Configuration Example 1 and Configuration Example 2, respectively, of an electromagnetic wave generator according to Embodiment 1. Both examples have a commonality in utilizing an AG (Alternating Gradient) focusing accelerator (FIGS. 1 and 2 are taken from Non-Patent Literature 2 and Patent Literature 2, respectively); by implementing a predetermined control that utilizes the characteristics of the AG focusing accelerator, a high-performance electromagnetic wave generator can be realized.

[Non-Patent Literature 2] H. Tanaka, T. Nakanishi, "DESIGN AND CONSTRUCTION OF A SPIRAL MAGNET FOR A HYBRID ACCELERATOR", Proceedings of the 1st Annual Meeting of Particle Accelerator Society of Japan and the 29th Linear Accelerator Meeting in Japan (Aug. 4-6, 2004, Funabashi Japan), 465p-467p

[Patent Literature 2] Japanese Laid-Open Patent Publication No. 2004-296164

In FIG. 1, Reference Numeral 11 designates an electron generation device that generates an electron beam; Reference Numeral 12 designates spiral-shape spiral magnetic poles that are arranged in such a way that the electron-beam orbit is sandwiched between the spiral magnetic poles, in a direction perpendicular to the plane of the paper, and that generate a magnetic field having a direction perpendicular to the plane of the paper; and Reference Numeral 13 designates a return yoke. The spiral magnetic poles 12, the return yoke 13, and a coil (details are omitted) wound around the spiral magnetic poles form a deflection electromagnet (referred to as a spiral deflection electromagnet, hereinafter). Reference Numeral 14 designates an acceleration core that generates an AC magnetic field for accelerating a circulating electron beam; Reference Numeral 15, a target that collides with a circulating electron beam to generate X-rays; Reference Numeral 16, an electron closed orbit within the generator when an electron is injected; Reference Numeral 17 designates a boundary electron closed orbit that is a boundary between a region A where a circulating electron beam does not collide with the target 15 and a region B where a circulating electron beam collides with the target 15; Reference Numeral 18, an outmost circumference of a region in which an electron beam can stably circulate; and Reference Numeral 19 designates electromagnetic waves, such as X-rays (hereinafter, the explanation will be implemented, considering X-rays as the electromagnetic waves), that are generated at the target 15. The energy of X-rays to be generated varies, depending on the energy of an electron beam that collides with the target.

Next, the operation of the electromagnetic wave generator will be explained. When being injected into the electromagnetic wave generator, an electron beam generated by the electron generation device 11 is deflected by spiral deflection electromagnet, thereby circulating within the generator while being accelerated by the electric field induced by the magnetic field of the acceleration core 14, in the circumferential direction illustrated in FIG. 1. In the vicinity of the spiral magnetic pole 12, the electron beam inside the generator travels along an approximately arc-shaped orbit, and in a space where the spiral pole does not exist, the electron beam travels along an approximately linear orbit; both the orbits configure a closed orbit. When the electron beam passes through the vicinity of the spiral deflection electromagnet, the radius of a circle along which the electron beam is deflected varies in response to increase in energy of the electron beam and to strength of the deflection magnetic field created by the deflection electromagnet. Generally, with acceleration, the deflection radius increases, whereby the electron closed orbit is enlarged in the radial direction. Because the injection, of electrons, from the electron generation device 11 is continuously carried out for a specific time period, the initially injected electron circulates along an outermost orbit, and the lastly injected electron circulates along an innermost orbit; the intermediately injected circulates along an orbit between the outermost and innermost orbits. Accordingly, electrons inside the accelerator circulate along closed orbits spread in the radial direction. In terms of the foregoing fact, the electromagnetic wave generator according to Embodiment 1 basically differs from an electromagnetic wave generator utilizing a betatron accelerator.

As discussed above, electrons circulate along radially spread orbits; therefore, compared with the case where electrons circulate along the same orbits, the density of electrons within circulating electron beams is low, whereby the coulomb repulsion that acts between electrons is also reduced. In consequence, in contrast to a betatron accelerator and a storage ring, the electromagnetic wave generator according to Embodiment 1 enable a high-current beam to be injected and utilized.

With acceleration, within a region A where a circulating electron beam does not collide, the electron beam enlarges its closed orbit in the radial direction, and then is accelerated so as to have predetermined energy; thereafter, through control described later, the electron beam reaches beyond the boundary electron closed orbit 17 a region B where the electron beam collides, and then collides with the target 15, whereupon X-rays 19 are emitted. The electron beam being accelerated circulates within the region A where the target 15 is not installed and no collision occurs; therefore, the wasteful loss, due to collision with the target 15, of an electron beam being accelerated does not caused. In addition, in order not to absorb and reduce the generated X-rays, the target 15 is formed in such a way as to be thin in the direction in which electron beams circulate, i.e., in the direction in which X-rays are generated. Electron beams can stably circulate also in the collision region B; therefore, even after an electron beam has collided with the target 15, most electrons, in the electron beam, that have not collided can continue to circulate stably, whereby, in accordance with control method for electron-beam closed orbits, recurrent collision between the electron beams and the target 15 is enabled.

In addition, in FIG. 1, the electron generation device 11 is installed inside the electromagnetic wave generator; however, the electron generation device 11 may be arranged under the electromagnetic wave generator, and the same effect can be demonstrated. The foregoing method is the same kind as an injection method illustrated in FIG. 2; however, in order to avoid the interference, due to arrangement positions, with the acceleration core 14, the electron generation device 11 is arranged, for example, under the accelerator.

In this situation, because the electromagnetic wave generator according to the present invention is configured in such a way that the deflection electromagnet utilized therein realizes a magnetic field that inclines in the radial direction, through contrivance on its shape, e.g., varying in the radial direction the space between the poles, and a so-called edge focusing is utilized in which, by utilizing the edge angle at the magnet boundary and the leakage magnetic field of the spiral pole 12, an electron beam is focused, stable circulation of an electron beam is enabled in both the non-collision region A and the collision region B (Non-Patent literature 2); however, the shape of the magnetic pole is not limited to a spiral-magnetic-pole shape, but an arbitrary shape may be accepted, as long as it can realize a radial-direction gradient magnetic field and maintain focusing force for electron beams, in corporation with its edge shape.

FIG. 2 illustrates an example of an electromagnetic wave generator including an AG focusing accelerator utilizing a non-spiral deflection electromagnet. In FIG. 2, Reference Numeral 21 designates a septum electrode for leading an electron beam from the electron generation device 11 into an electromagnetic wave generator; Reference Numeral 22, a deflection electromagnet for deflecting the orbit of a traveling electron beam to form a closed orbit; Reference Numeral 23, an acceleration core that accelerates an electron beam; Reference Numeral 24, a vacuum duct through which an electron beam circulates; Reference Characters 25*a*, 25*b*, 25*c*, and 25*d* designate respective typical closed orbits for electron beams within the vacuum duct 24; Reference Numeral 26, an acceleration-core power source for supplying the acceleration core 23 with electric power; Reference Numeral 27, a deflection-electromagnet power source; and Reference Numeral 15 designates the target as an X-ray generation source.

Next, the operation of the electromagnetic wave generator will be explained. An electron beam generated in the electron generation device 11 is injected through the septum electrode 21 into the accelerator and, in the vicinity of the deflection electromagnet 23, travels along an approximately arc-shaped orbit, thereby forming a closed orbit. The circulating electron beam is accelerated by an induction electric field created through electromagnetic induction caused by applying an AC magnetic field to the acceleration core 23. Electrons circulate through the vacuum duct 24. Reference Characters 25*a*, 25*b*, 25*c*, and 25*d* designate respective typical closed orbits for electron beams. In this case, as is the case with the example illustrated in FIG. 1, within a region where an electron beam can stably circulate, a region A (the region to which the closed orbits 25*a* and 25*b* belong) where an electric beam does not collide with the target 15 and a region B (the region to which the closed orbits 25*c* and 25*d* belong) where an electric beam collides with the target 15 can be formed.

The injected electron beam circulates along an orbit that, within the non-collision region A, has spread in the radial direction, in accordance with the time that has elapsed from the timing of injection, while being accelerated. As is the case with the example illustrated in FIG. 1, the electron that has been accelerated so as to have predetermined energy collides with the target 15 arranged in the collision region B, thereby generating X-rays. In addition, in FIG. 2, the target 15 is drawn, with its radial dimension enhanced; however, the target 15 is basically the same as the example in FIG. 1.

Additionally, in FIG. 2, the electron generation device 11 is disposed outside the accelerator and electrons are injected through the septum electrode 21 into the closed orbit; however, as is the case with the example illustrated in FIG. 1, arrangement of the electron generation device 11 inside the accelerator demonstrates the same effect and furthermore makes the entire generator compact.

In both examples illustrated in FIGS. 1 and 2, in general, the target 15 is a wire-shape metal having a diameter of approximately 10 μm, or more preferably a heavy metal such as tungsten, and installed within the accelerator in such a way that the longitudinal direction of the wire corresponds to the direction perpendicular to the plane of the paper (in FIG. 2, the target 15 is drawn, with its radial dimension enlarged). The foregoing method determines the radial dimension of the X-ray generation source and suppresses to a small level the self absorption, of generated X-rays, by the target 15. However, in the case of a wire target, the dimension, in the longitudinal-length direction of the wire, of the X-ray generation source is determined by the dimension, in the same direction as the longitudinal-length direction of the wire, of an traveling electron beam, and normally becomes several mm. In order to reduce the foregoing dimension of the X-ray generation source, it is conceivable that the target 15 is formed by, in a wire made of a substance having a low atomic number (including effective atomic number), such as carbon, filling a microscopic sphere made of a substance having an atomic number (including effective atomic number) higher than that of the wire, for example, a metal or more preferably a heavy metal such as tungsten. The reason why a substance having an atomic number higher than that of the wire is utilized is that it has high efficiency in generating X-rays, thereby enabling the intensity of X-rays to be increased and two dimensions of the light source to be reduced.

Next, the electron-beam control in an electromagnetic wave generator utilizing the AG focusing accelerator will be explained. In both cases illustrated in FIGS. 1 and 2, the movement of an electron beam is controlled mainly by the combination of the change with time of the magnetic field created by the deflection electromagnet (shortly referred to as a deflection magnetic field) and the change with time of the acceleration-core magnetic field.

Figure 3:
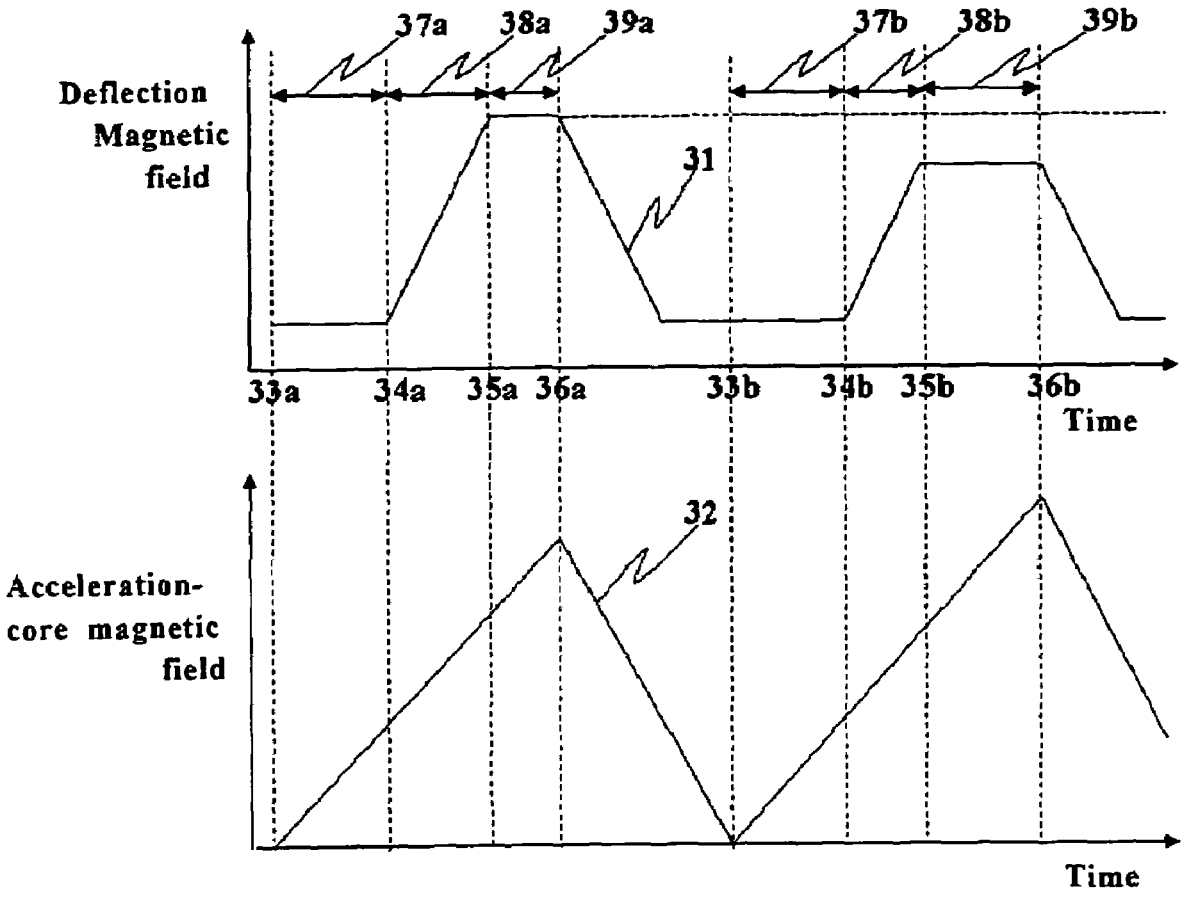
FIG. 3 is a set of graphs representing respective patterns 1 of changes with time of a deflection magnetic field and an acceleration-core magnetic field.

FIG. 3 represents respective patterns 1 of changes with time of the deflection magnetic field and the acceleration-core magnetic field. Graph 31 represents the change with time of the deflection magnetic field, and Graph 32 represents the change with time of the acceleration-core magnetic field. In both graphs, the abscissa denotes the time; the positions indicated by Reference Characters 33*a* and 33*b* are respective injection-start time points at which injections are started; the positions indicated by Reference Characters 34*a* and 34*b* are respective injection-end time points at which injections are completed; the positions indicated by Reference Characters 35*a* and 35*b* are respective time points at which control instances through constant deflection magnetic fields are started; and the positions indicated by Reference Characters 36*a* and 36*b* are respective time points at which control instances through the constant deflection magnetic fields are completed. The time periods indicated by Reference Characters 37*a* and 37*b* are respective electron-beam injection durations in which injections of electron beams are started and completed; the time periods indicated by Reference Characters 38*a* and 38*b* are respective electron-beam acceleration durations in which, after the injections, the electron beams are accelerated so as to have predetermined energy. The time periods indicated by Reference Characters 39*a* and 39*b* are respective target-collision durations corresponding time spans in which the electron beams that have been accelerated so as to have predetermined energy are further accelerated to collide with the target, the electron-beam closed orbits are enlarged to the orbit in which the target 15 is arranged, the electron beams are made to collide with the target 15, and the collisions are maintained.

The relationship between the change with time 31 of the deflection magnetic field and the change with time 32 of the acceleration-core magnetic field does not satisfy the betatron accelerator condition. The betatron accelerator condition signifies the relationship, between the deflection magnetic field and the acceleration-core magnetic field, in which the closed orbit of an electron beam being accelerated is constant. Accordingly, the fact that the relationship between the change with time 31 of the deflection magnetic field and the change with time 32 of the acceleration-core magnetic field does not satisfy the betatron accelerator condition suggests that the closed orbit of an electron beam being accelerated is not constant.

In the first place, the behavior, in the time period from 33*a* to 36*a*, of an electron beam will be explained below. At the injection-start time point 33*a*, injection of electrons into the electromagnetic wave generator is started; at the injection-end time point 34*a*, the injection is completed. In this situation, during the electron-beam injection duration 37*a* that begins at the injection-start time point 33*a*, the acceleration-core magnetic field increases with time, as the change with time 32, represented at the lower side of FIG. 3, of the acceleration-core magnetic field. Due to the acceleration-core magnetic field, an induction electric field is created in the traveling direction of the electron beam; therefore, the injected electron beam is continuously accelerated during the electron-beam injection duration 37*a*. During the electron-beam injection duration 37*a*, the deflection magnetic field is constant; as the closed orbits 25*a* and 25*b* illustrated in FIG. 2, the orbit of the electron beam is gradually spread outward, with increase in the acceleration-core magnetic field. During the electron-beam injection duration 37*a*, electron beams are continuously injected; therefore, at the injection-end time point 34*a*, electron beams are to circulate, while spreading in the radial direction. At the injection-end time point 34*a*, the electron beam that has been injected at the injection-start time point 33*a* is to circulate with the highest energy, along an orbit (e.g., the closed orbit 25*b*) in the vicinity of the outermost orbit. In contrast, the electron beam that has been injected immediately before the injection-end time point 34*a* is to circulate with the lowest energy, along an orbit (e.g., the closed orbit 25*a*) in the vicinity of the innermost orbit. In other words, at the injection-end time point 34*a*, the electrons are to have respective energy levels within a predetermined range and to circulate along respective orbits spread in the radial direction. A conventional betatron accelerator employs a weak focusing magnetic field, whereby it is difficult to obtain focusing force that is constant in orbits, having different radiuses, in a spread region; however, in the case of an AG focusing accelerator, through contrivance on the shape of the deflection electromagnet, it is possible to obtain focusing force that is approximately constant in orbits, having different radiuses, in a spread region, whereby the closed orbit can arbitrarily be varied.

After the injection-end time point 34*a*, the behavior of the electron beam is transferred to a condition corresponding to the electron-beam acceleration duration 38*a*. The electron beam circulates in a region spread in the radial direction, for example, in a region in which the radius of the arc-shaped orbit in the vicinity of the deflection electromagnet is from r1 to r2 (assuming that r1 is smaller than r2); in an orbit having a specific radius r0 that is between r1 and r2, the deflection magnetic field and the acceleration-core magnetic field vary, while maintaining a condition that is close to the betatron acceleration condition. Accordingly, when, due to acceleration, the energy levels of electron beams vary, the electron beams circulating along orbits other than the orbit having a radius of r0 converge around the orbit having a radius of r0. In a macroscopic view, with acceleration, an electron beam is accelerated, while reducing its diameter. The radius r0 is decided through a balance between the increasing speed of the deflection magnetic field and the increasing speed of the acceleration-core magnetic field. The electron beams have energy levels within a predetermined range and are accelerated along orbits spread in the radial direction. As described above, the spread of the closed orbits, at the beginning of the injection, in the radial direction reduces with acceleration; however, the electron beams are accelerated, with their orbits being spread. Whatever the case may be, during the electron-beam acceleration duration 38*a*, the closed orbit of the electron beam is controlled in such a way as to stay within the non-collision region A.

Thereafter, when the maximal energy of the electron reaches a predetermined value, i.e., at the time point 35*a*, by making the deflection magnetic field constant, the behavior of the electron beam is transferred to a condition corresponding to the target-collision duration 39*a*. Because, during the target-collision duration 39*a*, the acceleration-core magnetic field still increases, the closed orbit of the electron beam is further enlarged in the radial direction; thus, the electron beam is led to the collision region B and collides with the target 15, thereby generating X-rays. In this situation, electron beams circulate, while spreading in the radial direction; therefore, during the target-collision duration 39*a*, electrons circulating along respective orbits from the outermost orbit to an inner orbit subsequently collide with the target 15; however, because the spreading speed, in the radial direction, of the electron-beam closed orbit is not high, the time required for one circulation of the electron beam is significantly short, compared with the time required for the circulating electron beam to traverse the target 15 in the radial direction. Accordingly, the electron beam circulates several times along the orbit in which the electron beam collides with the target 15. Additionally, because the collision region Bin which the target is installed is a stable circulation region, the electron beam stably continues to circulate during the target-collision duration 39*a*. As a result, it is possible to efficiently convert a circulating electron beam into X-rays.

As described above, the electromagnetic wave generator according to Embodiment 1 significantly differs from a conventional electromagnetic wave generator utilizing a betatron accelerator, in terms of the fact that an electron beam recurrently collides with the target, while circulating stably. The electromagnetic wave generator according to Embodiment 1 significantly differs from an electromagnetic wave generator utilizing a storage ring, in terms of the spreading of the closed orbit. Whatever the case may be, the foregoing features make the electromagnetic wave generator according to Embodiment 1 suitable for accelerating a large-current beam; therefore, an effect can be demonstrated in which a small generator can generate high-intensity X-rays.

The foregoing explanation has been made on the assumption that, during the target-collision duration 39*a* in FIG. 3, the change with time 31 of the deflection magnetic field is constant; however, because the relationship between the deflection magnetic field and the acceleration-core magnetic field has only to be off the betatron acceleration condition, the change with time 31 is not limited to a constant change, and a deflection magnetic field that gradually increases with time may be employed. In this case, the behavior of an electron beam and the collision between the electron beam and the target 15 are basically the same as those in the case where the deflection magnetic field is constant during the target-collision duration 39*a*; however, the spreading speed, in the radial direction, of the closed orbit is reduced. As a result, by implementing the control such as this, the duration of collision between a circulating electron beam and the target 15 can be prolonged, whereby the efficiency of conversion of a circulating electron beam into X-rays is further enhanced.

In general, after the target-collision duration 39*a* elapses, due to collision with the target 15, the electron beam has almost disappeared. Accordingly, there is no specific restriction on the step in which, thereafter, the deflection magnetic field and the acceleration-core magnetic field are restored to the respective initial conditions. In FIG. 3, after the time period 36*a*, both the magnetic fields are reduced at a speed approximately the same as that during the acceleration; however, other methods may be employed. After the deflection magnetic field and the acceleration-core magnetic field are restored to the respective injection conditions, by repeating steps after and including the electron-beam injection and by, in each case, injecting and accelerating new electrons so as to collide with the target, X-rays can be generated continuously.

During the repetition process, the patterns of respective changes with time in the deflection magnetic field and the acceleration-core magnetic field may be the same in each case, or may be changed each time the injection is implemented. An example of the latter method is represented from the time point 33*b* to the time point 36*b* in FIG. 3. In the case of the second injection in FIG. 3, the timing at which the deflection magnetic field is made constant is advanced compared with the case of the first injection. The electron-beam acceleration duration 38*b* in FIG. 3 is set to a shorter value than the electron-beam acceleration duration 38*a* is. Assuming that the respective gradients of changes with time in the deflection magnetic field and the acceleration-core magnetic field are the same between the first case and the second case, the deflection magnetic field is maintained constant at a lower value, by setting the electron-beam acceleration duration 38*b* shorter. Accordingly, at the time point 35*b*, the energy of an electron beam is lower than that of electrons, at the time point 35*a*.

In this situation, through the increasing acceleration-core magnetic field, the electron beam is further accelerated; because the deflection magnetic field is maintained at a constant value, the spreading speed, in the radial direction, of the closed orbit is increased compared with the first case. In consequence, because the electron beam earlier reaches the collision region B and collides with the target 15, the energy of the electron beam that collides with the target 15 is lower than that of an electron beam that, in the first case, collides with the target 15. Accordingly, the energy of an electron beam that collides with the target 15 can readily be changed. In addition, an electron beam does not collide with the target 15 immediately after the time reaches the time point 35*a*, or 35*b*; the timing at which the electron beam starts the collision varies depending on the distance, in the radial direction, between the electron-beam closed orbit and the target 15 at the timing when the time reaches the time point 35*a* or 35*b*. In other words, strictly speaking, X-rays are generated when a predetermined time period has elapsed after the time point 35*a* or 35*b*.

Figure 4:
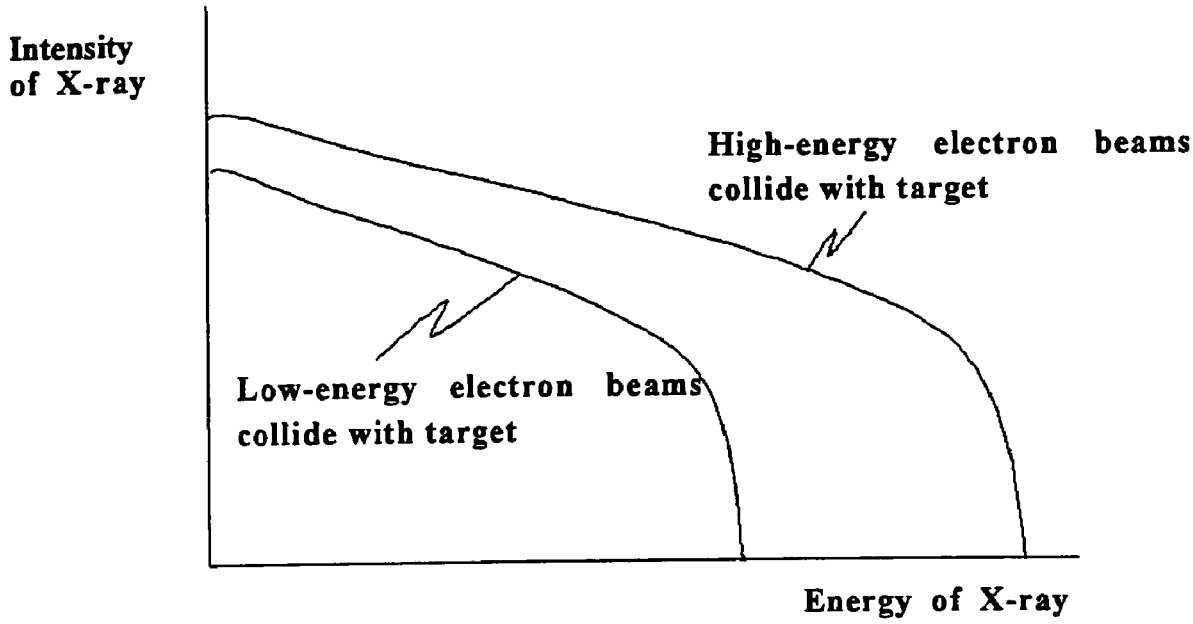
FIG. 4 is a graph representing a spectrum of the X-ray energy with parameter of the electron-beam energy.

FIG. 4 conceptually represents a state in which the energy spectrum of X-rays generated at the target 15 varies depending on the energy level of an electron beam that collides with the target 15. From FIG. 4, it can be seen that the higher energized electron beam collides with the target 15, the higher energized X-rays can be generated. As described above, the energy of generated X-rays can be changed, by controlling the energy of an electron beam that collides with the target 15.

In addition, in the example described above, it has been explained that an electron beam is accelerated through an induction electric field created by the acceleration-core magnetic field; however, if an acceleration device utilizing a radio-frequency electric field is employed instead, the same effect can be demonstrated. The foregoing fact can be applied to every embodiments described later.

Additionally, in the foregoing example, it has been explained that, during the injection, the deflection magnetic field is constant, and, when the time reaches the time point 34*a* or 34*b*, the strength of the deflection magnetic field suddenly starts to increase at a constant gradient; however, as long as a condition enabling the injection is ensured, the strength of the deflection magnetic field is not necessarily required to increase; moreover, the deflection magnetic field at the time point 34*a* or 34*b* may be obtained by providing a smoothing duration and gradually increasing the strength of the magnetic field at the timing of the injection. Even though the foregoing method is applied, the essential behavior, described above, of an electron beam does not change.

Furthermore, in the foregoing example, it has been explained that, in the vicinity of the magnetic pole, the orbit is arc-shaped, and, in a region away from the magnetic pole, the orbit is approximately linear; however, even in a region away from the magnetic pole, the orbit may be arc-shaped in the case where the strength of the deflection magnetic field is high. In this regard, however, that arc has a radius longer than that of the arc of an orbit in the vicinity of the magnetic pole. Even so, the essential behavior, toward the target 15, of an electron beam does not change.

As described heretofore, according to Embodiment 1, the generator can accelerate large-current electron beams, make an electron beam circulate under a stable condition, even while X-rays are generated, and readily change the energy of an electron beam that collides with the target 15; therefore, a high-intensity X-ray source can readily be realized and the energy of generated X-rays can readily be changed. In addition, because, as described above, the intensity of generated X-rays can be raised, it is possible that, in use of the X-rays for various fields, the exposure time is shortened and the measurement or the like is speeded up. Moreover, even though the target is miniaturized, X-rays can be generated that, due to their intensity, are substantially usable, whereby the miniaturization of the X-ray generation source can be realized. Accordingly, for example, in the case where the miniaturized X-ray generation source is utilized so as to obtain an X-ray image, an image can be obtained whose resolution is higher than that of an image obtained through a conventional X-ray generation source. Specifically, although depending on its dimensions, a generator can be realized that generates X-rays whose intensity is high enough to be used in the medical or industrial field and whose size is about 10 μm.

Still moreover, owing to employing a deflection electromagnet having a focusing function, the accelerator can significantly be downsized; therefore, compared with an electromagnetic wave generator utilizing a conventional accelerator, significant downsizing of an electromagnetic wave generator is enabled. As a result, it is possible that, in use for various kinds of applications, a convenient and easy-to-use light source is realized. Furthermore, the downsizing enables reduction of costs. The downsizing and simplification of the structure, by providing the deflection electromagnet with the focusing function, largely contribute to the reduction of costs.

Embodiment 2

Figure 5:
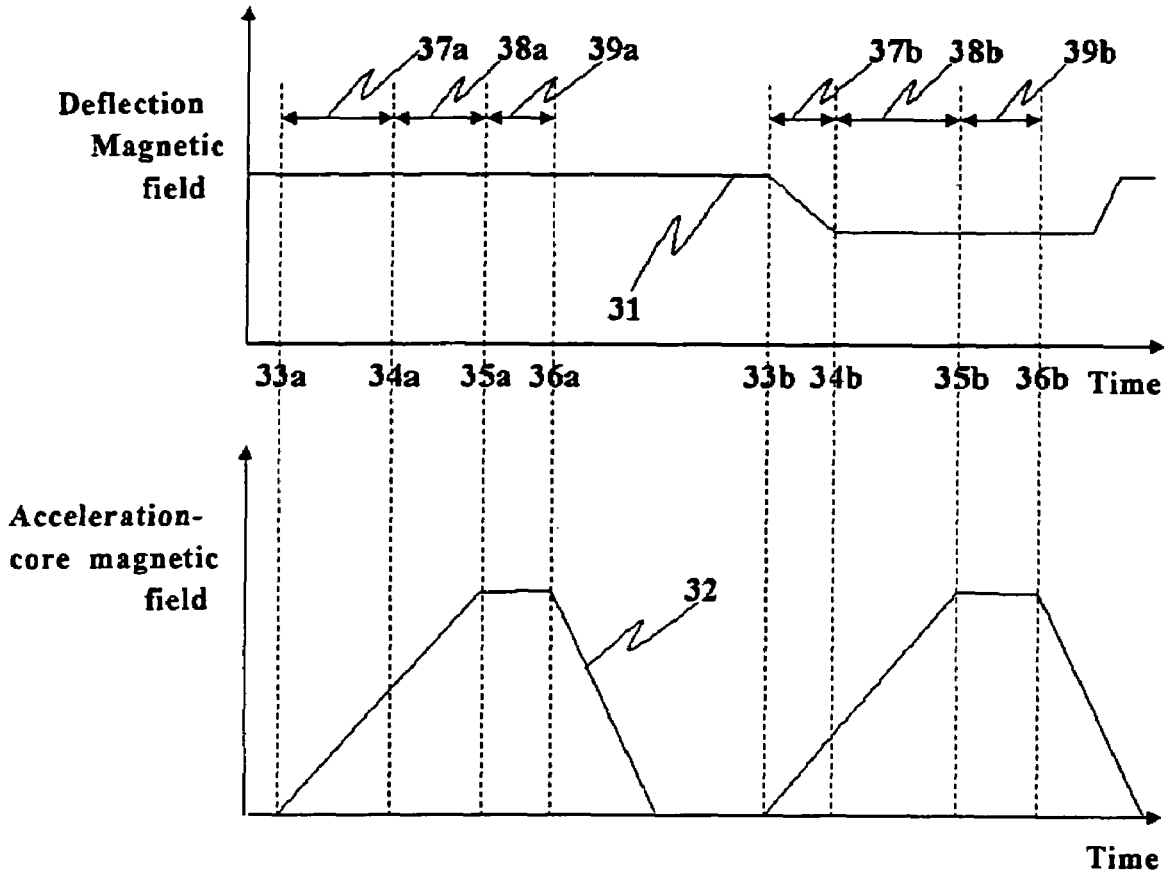
FIG. 5 is a set of graphs representing respective patterns 2 of changes with time of a deflection magnetic field and an acceleration-core magnetic field.

In Embodiment 2, compared with Embodiment 1, the extent to which, during the injection, an electron-beam closed orbit spreads in the radial direction is enlarged. FIG. 5 represents respective patterns 5 of changes with time of the deflection magnetic field and the acceleration-core magnetic field in the case where Embodiment 2 is applied. In FIG. 5, like reference characters designate like items in FIG. 3. The first half portion of the graph at the upper side in FIG. 5 represents an example of the case where the strength of the deflection magnetic field is constant in the entire process. In this case, the spread, in the radial direction, of an electron-beam closed orbit, due to the acceleration, is larger than that in the case of FIG. 3. The second half portion of the graph at the upper side in FIG. 5 represents an example of the case where, during the electron-beam injection, the strength of the deflection magnetic field is reduced. In this case, the spread, in the radial direction, of an electron-beam closed orbit, due to the acceleration, is further larger than that in the case where the strength of the deflection magnetic field is constant. Although both cases have a shortcoming that the size of the accelerator necessary for accelerating an electron beam so as to have predetermined energy is rendered large, the density of electron beams in a closed orbit is reduced instead; therefore, it is possible to prolong the electron-beam injection duration to inject a high-current beam. Accordingly, acceleration of a larger electron beam is enabled, whereby the intensity of X-rays becomes further larger than that in the case of Embodiment 1. Moreover, except for what has been described above, Embodiment 2 demonstrates the same effect as that described for Embodiment 1.

Embodiment 3

Figure 6:
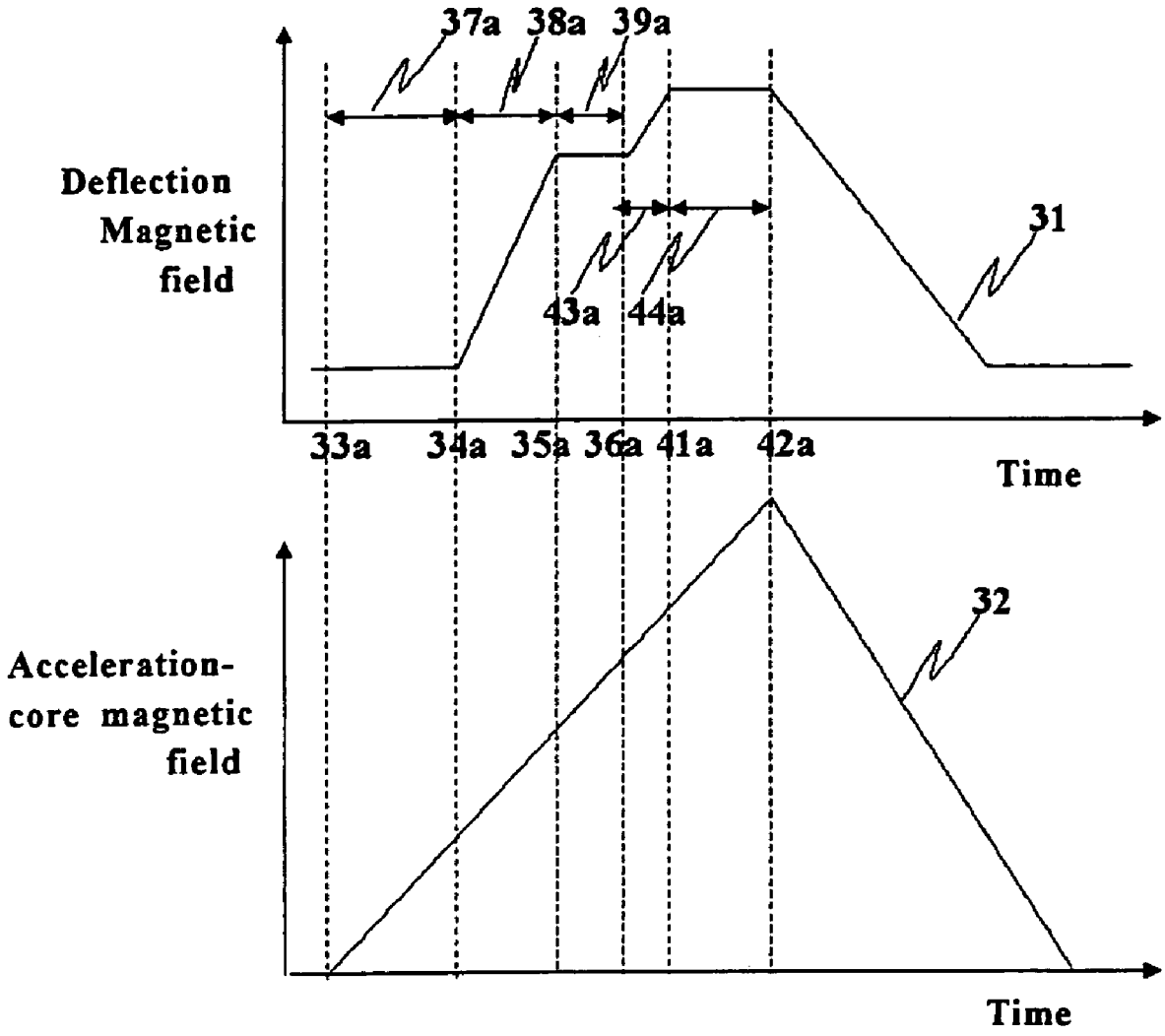
FIG. 6 is a set of graphs representing respective patterns 3 of changes with time of a deflection magnetic field and an acceleration-core magnetic field.

In Embodiment 3, by changing at high speed the energy of an electron beam, the energy levels of generated X-rays are switched at high speed, without implementing injection of another electron beam. FIG. 6 represents respective patterns of changes with time of the deflection magnetic field and the acceleration-core magnetic field in the case where Embodiment 3 is applied. In FIG. 6, explanations for time points 31 to 39*a* are the same as those in FIG. 3. In FIG. 6, Reference Character 36*a* designates a time point at which an electron-beam reacceleration duration 43*a* corresponding to the electron-beam acceleration duration 38*a* starts, as well as a time point at which the control for maintaining the deflection magnetic field constant ends. Reference Character 41*a* designates a time point at which a target-recollision duration 44*a* corresponding to the target-collision duration 39*a* starts, as well as a time point at which the electron-beam reacceleration duration 43*a* ends. Reference Character 42*a* designates a time point at which the target-recollision duration 44*a* ends.

Next, the operation of the electromagnetic wave generator according to Embodiment 3 will be explained. The process from the time point 33*a* to 36*a* is the same as that in the case of FIG. 3. What is different is that, in the halfway of the target-collision duration 39*a*, the electron-beam reacceleration duration 43*a* corresponding to the electron-beam acceleration duration 38*a* is provided so as to temporarily shift an electron beam off the position of collision with the target 15 and to restore the reaccelerated electron beam to the position of collision with the target 15.

In other words, under the condition that, during the target-collision duration 39*a*, a circulating electron beam has not completely disappeared, the deflection magnetic field is enhanced. By making the speed of the increase in the deflection magnetic field, during the electron-beam reacceleration duration 43*a*, higher than that during the electron-beam acceleration duration 38*a*, the radius of the electron-beam closed orbit is reduced. Accordingly, the circulating electron beam retreats to the non-collision region A. Because, during the electron-beam reacceleration duration 43*a*, the acceleration-core magnetic field continues to increase, the electron beam is continuously accelerated, whereby its energy increases; however, the closed orbit is maintained within the non-collision region A. At the time point 41*a* at which the electron beam has been energized to a predetermined energy level, the deflection magnetic field is made constant again. In consequence, due to increase in the acceleration-core magnetic field, the energy of the electron beam further increases, whereby the closed orbit is enlarged in the radial direction; therefore, the electron beam, with energy larger than energy that the electron beam has had during the target-collision duration 39*a*, collides with the target 15 arranged in the collision region B.

As described above, the respective energy levels of X-rays that are generated during the target-collision duration 39*a* and during the target-recollision duration 44*a* can be switched readily and at high speed. In this example, the energy levels of X-rays that are generated during the target-recollision duration 44*a* are higher than those of X-rays that are generated during the target-collision duration 39*a*.

In addition, it is not necessarily required to control the respective changes with time, during the target-collision duration 39*a* and during the target-recollision duration 44*a*, of the deflection magnetic field so as to be constant; the deflection magnetic field may be increased with time. The particular effect of the foregoing method and other effects are the same as those described for Embodiment 1.

Embodiment 4

Although, in Embodiments 1 to 3, it has been explained that an electron beam is injected inside the electromagnetic wave generator, it is not necessary to limit the injection to be implemented under that condition; it is possible to provide the electron generation device 11 in the vicinity of the outer circumference of the electromagnetic wave generator, so as to inject an electron beam from the electron generation device 11, from the vicinity of the outer circumference of the electromagnetic wave generator. In order to realize that injection condition, it is necessary to reduce in the radial direction the electron-beam closed orbit, at the timing of injection and during acceleration. That condition will be explained with reference to FIG. 3.

In the first place, the deflection magnetic field during the electron-beam injection duration 37*a* is required not to be constant but to increase with time. In the case where the deflection magnetic field is constant, increase in the electron-beam energy due to increase in the acceleration-core magnetic field enlarges the closed orbit in the radial direction; however, by increasing the deflection magnetic field with acceleration, the closed orbit is reduced instead, in the radial direction.

Additionally, by increasing the deflection magnetic field in such a way that the change with time thereof during the time period corresponding to the electron-beam acceleration duration 38*a* is more rapid than that represented in FIG. 3, the electron-beam closed orbit can be reduced in the radial direction, while the electron beam is accelerated, even in the acceleration step after the injection. Accordingly, in this case, the target 15 as an X-ray generation source is arranged in an inner closed orbit. It is required that electrons, which are to be accelerated at the time point 35*a* so as to have predetermined energy and circulates along an orbit in the vicinity of the inner predetermined closed orbit, are made to collide with the target 15 arranged in a more inner orbit than that orbit. For that purpose, it is necessary that, while the electron beam is accelerated or the energy thereof is kept constant during the target-collision duration 39*a*, the deflection magnetic field is increased so as to further reduce inward the electron-beam closed orbit; however, this requirement is readily satisfied. With the condition being maintained during the target-collision duration 39*a*, electron beams that circulate along the orbits, in a spread fashion, subsequently collide with the target 15, thereby generating X-rays.

In addition, in the foregoing example, the target 15 is arranged in an inner orbit; however, the target 15 may be arranged in an outer orbit. In that case, because, immediately after being injected, an electron beam collides with the target 15 in a short time, it is necessary to create an injection condition under which an electron beam passes across the target 15; however, the injection condition is readily realized, by controlling the respective patterns of the changes with time of the deflection magnetic field and the acceleration-core magnetic field. In this case, the collision region B where an electron beam collides with the target 15 is situated outer than the non-collision region A where an electron beam does not collide with the target 15; an electron beam that, after being injected, has rapidly passed through the region B is accelerated in the region A, and with the deflection magnetic field being reduced, circulates again in the region B. X-rays can be utilized that are generated through the collision between the electron beam and the target 15.

In order to change the energy of an electron beam that collides with the target, each time the injection is implemented, the respective patterns of the changes with time in the deflection magnetic field and the acceleration-core magnetic field may be changed. Additionally in order to vary the energy of an electron beam that collides with the target 15, in the case the injection is implemented only one time, the respective patterns of the changes with time in the deflection magnetic field and the acceleration-core magnetic field may be varied, as is the case with Embodiment 3. The foregoing characteristics for an X-ray generation source are attributed to the fact that the electromagnetic wave generator has stable closed orbits spread in the radial direction; therefore, with an electromagnetic wave generator utilizing a conventional betatron acceleration, the characteristics can be realized by no means.

By employing a method in which an electron beam is injected from the vicinity of the outer circumference of a generator, the degree of freedom in arranging the electron generation device 11 is enhanced, whereby a generator can be realized that is compact as a whole. The other effects are the same as those described for Embodiments 1 and 3.

Embodiment 5

In Embodiment 5, with its energy maintained, an electron beam is reciprocated between the non-collision region A and the collision region B. Embodiment 5 will be explained with reference to FIG. 6. In FIG. 6, the energy of an electron beam during the target-collision duration 39*a* is different from that during the target-recollision duration 44*a*; however, by controlling the acceleration-core magnetic field during the electron-beam acceleration duration 43*a*, thereby maintaining the energy of an electron beam at a constant value, and by increasing or reducing the deflection magnetic field, the closed orbit can be changed.

In addition, it has been explained that, assuming that only one each of the non-collision region A and the collision region B exist, and electron beam reciprocates between the closed orbit in region A and the closed orbit in region B. However, by situating within the collision region B a closed orbit in which the target 15 is arranged, providing a non-collision region A1 on the opposite side, in the radial direction, of the non-collision region A that has been explained heretofore, with respect to the collision region B where an electron beam collides with the target, and controlling the respective patterns of the changes with time in the deflection magnetic field and the acceleration-core magnetic field, thereby making the electron-beam closed orbit shift among the regions A, B, and A1, the ON/OFF control of X-ray generation can be implemented. In that case, as explained heretofore, because the energy of an electron beam can be varied, the energy of X-rays that are generated in synchronization with the ON/OFF control can be switched at high speed.

What is claimed is:

1. An electromagnetic wave generator including:

an Alternating Gradient (AG) focusing circular accelerator;

a controller; and a target, wherein the circular accelerator comprises an electron generator for generating electrons, an injector for injecting the electrons generated by the electron generator into the AG focusing circular accelerator, an acceleration core for generating an AC magnetic field for accelerating the electrons with an electric field induced by the magnetic field generated by the acceleration core, and a deflection electromagnet for generating a deflection magnetic field inclining in a radial direction of the circular accelerator for deflecting the electrons injected into the circular accelerator and accelerated electrons to form circular orbits, and an edge focusing magnetic field applying an approximately constant focusing force to elections passing through the edge focusing magnetic field, and producing stable electron circulation orbits spread over the radial direction of the AG focusing circular accelerator, the controller controls a time dependent relationship of intensity of the deflection magnetic field and the acceleration magnetic field to produce a first prescribed core pattern, whereby the injected electrons are accelerated and circulate along the orbits spread over the radial direction during injection by the injector and orbital radii of the orbits of the circulating electrons are varied after injection, and the target is disposed within the stable electron circulation orbits and the accelerated electrons are made to collide with the target by varying the orbital radii of the circulating electrons, whereby electromagnetic waves are generated.

2. The electromagnetic wave generator according to claim 1, wherein, during injection and acceleration of the electrons, the controller controls the deflection magnetic field to have a constant intensity.

3. The electromagnetic wave generator according to claim 1, wherein, during injection of the electrons, the controller controls the deflection magnetic field to have an intensity that decreases with time.

4. The electromagnetic wave generator according to claim 1, wherein the controller controls the time dependent relationship of intensity of the deflection magnetic field and of the acceleration core magnetic field to have a second prescribed core pattern, after injection of the electrons so that, by increasing and decreasing each orbital radius of the circulating electrons at least once, the orbits of the circulating electrons cross the target at least two times.

5. The electromagnetic wave generator according to claim 1, wherein the injector injects the electrons through a periphery of the AG focusing circular accelerator and the controller controls the time dependent relationship of intensity of the deflection magnetic field and the acceleration core magnetic field to have a second prescribed core pattern so that each orbital radius of the circulating electrons is reduced upon acceleration of the electrons that are injected.

* * * * *